US005109211A

United States Patent [19]

Huber

[11] Patent Number: 5,109,211

[45] Date of Patent: Apr. 28, 1992

[54] HIGH VOLTAGE FUSE

[75] Inventor: William J. Huber, Waukesha, Wis.

[73] Assignee: Combined Technologies, Inc., Brookfield, Wis.

[21] Appl. No.: 669,911

[22] Filed: Mar. 15, 1991

[51] Int. Cl.[5] ..... H01H 85/04; H01H 85/143

[52] U.S. Cl. ..... 337/158; 337/247

[58] Field of Search ..... 337/247, 158, 159, 160, 337/161, 162

[56] References Cited

U.S. PATENT DOCUMENTS 2,115,436 4/1938 Utsunomiya ..... 337/247

2,567,420 9/1951 Bowie ..... 337/247

*Primary Examiner*—Harold Broome

*Attorney, Agent, or Firm*—Foley & Lardner

[57] ABSTRACT

A protective fuse assembly for a current limiting fuse of the type, including a dielectric housing enclosing the fuse, an end cap secured to the lower end of the fuse by a pyrotechnic charge assembly, the end cap supporting the housing on the fuse, an end cap mounted on the upper end of the fuse for centering the housing on the fuse, and an electrically conductive wire connecting the charge to the fuse whereby the charge is detonated when the fuse senses a fault current to release the lower end cap from the fuse so that the housing drops to the bottom of the fuse.

7 Claims, 2 Drawing Sheets

HIGH VOLTAGE FUSE

FIELD OF THE INVENTION

The present invention relates to current limiting fuses and more particularly to a protective system for maintaining the high dielectric characteristics of a fuse in a heavily contaminated environment.

BACKGROUND OF THE INVENTION

High voltage current limiting fuses are provided in high voltage distribution circuits to interrupt or isolate the circuit under fault current conditions. In order to provide positive interruption under these conditions, conductive end caps are mounted on each end of a fuse tube made of a very high grade of dielectric material so that it does not flash over when a high voltage is present across the end caps.

In this regard the two major problems confronting the dielectric material when used outdoors are ultraviolet rays from the sun and contaminants present in the atmosphere. It is generally recognized that ultraviolet rays can decompose organic dielectric materials which over time may decompose sufficiently to allow tracking and/or degradation of the mechanical properties between the end caps of the fuse. In the event of this type of failure flash over can occur between the end caps causing a disruption of the distribution circuit. Secondly, air contaminants over time can collect on the surface of the dielectric material resulting in a build up of materials which can be conductive when exposed to moisture. This can also lead to a flash over between the end caps also causing disruption of the distribution circuit.

These conditions have generally been resolved by increasing the length of the dielectric tube between the end caps of the fuse making flash over more difficult. However, in areas where severe contamination is present failure will still occur due to tracking. Efforts to overcome these problems have included the incorporation of mechanical devices which physically separate the terminals on disruption, thereby preventing any voltage stress from occurring across the dielectric material. Generally these devices allow the disconnected terminal to swing freely beneath the fuse which can be dangerous if it is at a high potential and comes close to a grounded object. These devices are also difficult to service in the field due to the difficulty in reconnecting the replacement element into the circuit.

SUMMARY OF THE PRESENT INVENTION

The current limiting fuse according to the present invention is designed to operate and maintain its high dielectric characteristic in both exposure to ultraviolet rays and heavy contamination. This has been accomplished by enclosing the current limiting fuse in a protective tube assembly which encloses the fuse body. Upon exposure to a fault current, a mechanism is triggered in the fuse which causes the outer tube to drop the ground wire away from the end cap at the bottom of the fuse tube. This exposes the dielectric fuse tube of the current limiting fuse which has been enclosed in the protective tube assembly to the atmosphere in a new condition which can withstand the high voltage present at the high voltage end cap of the fuse tube.

A primary advantage of this invention is thereby achieved in that the ground wire is moved away from the lower end cap of the fuse in such a way that the electrical wire is prevented from swinging into contact with a grounded object.

Another advantage of the present invention is the ability to prevent the protective tube assembly from rotating with respect to the fuse when the hot line clamps are released to disconnect the fuse from the distribution circuit.

Other principal features and advantages of the invention will become apparent to those skilled in the art upon review of the following drawings, the detailed description and the appended claims.

DETAILED DESCRIPTION OF THE DRAWINGS

Figure 1:
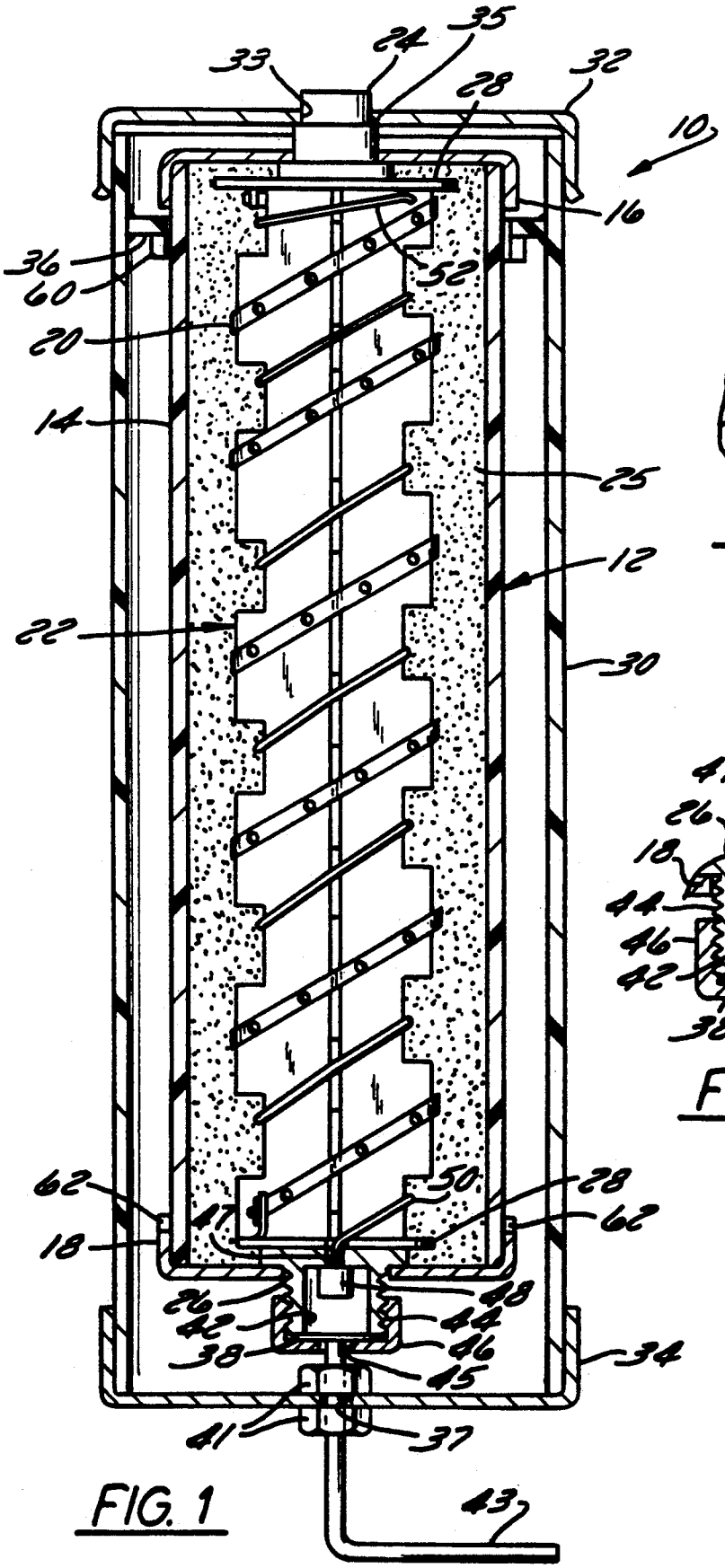
FIG. 1 is a cross section view in elevation of the protective assembly showing a current limiting fuse enclosed in the protective fuse assembly according to the invention.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purposes of description and should not be regarded as limiting.

DETAILED DESCRIPTION OF THE PREFERRED EMBODIMENTS

The protective tube assembly 10 according to the present invention is shown mounted on a current limiting fuse 12 such that the current limiting fuse 12 is completely enclosed within the protective assembly 10. As is generally understood the current limiting fuse 12 includes a tubular body 14 formed from a dielectric material which is closed at each end by end caps 16 and 18. A fuse element 20 is supported on a spider assembly 22 which is mounted within the tubular body 14 and is connected to each of the end caps 16, 18 by electrically conductive bosses 24 and 26. The fuse element 20 is spirally wrapped around the spider assembly 22 and is connected to an electrically conductive plate 28 at each end of the spider assembly. The plates 28 are connected to the bosses 24 and 26 as is generally understood in the art. The fuse tube is filled with a granular dielectric material 25. As is generally understood in the art, the fuse is connected to the distribution line and to ground by hot line clamps (not shown).

In accordance with the present invention the protective assembly 10 includes a protective tube 30 which is formed from a dielectric material and is closed at each end by end caps 32 and 34. The upper cap 32 includes a central opening 33 and is slipped onto the upper boss 24 with a snug fit. The cap 32 rests on a shoulder 35 on the upper boss 24. The lower cap 34 includes a central opening 37. An electrically conductive ground wire 43 is aligned in opening 37 and secured thereto by nuts 41. An internally threaded cap 46 having a central opening 45 is mounted on the threaded end 44 of boss 26. An electrically conductive metal plate 38 is mounted on the end of the wire 43 and is seated in the cap 46. The upper end of tube 30 slips into the upper cap 32 with a snug fit. The lower cap 34 is secured to the lower end of the tube 30 by an appropriate adhesive.

Means are provided in the assembly for supporting the tube 30 on the lower end cap 34. Such means is in the form of a support ring or flange 36 which is provided on the upper inner surface of the tube 30. The flange 36 closely surrounds the upper end of fuse tube 14. The tube 30 when released from the lower contact 26 as described below will slide down the tubular body 14 of fuse 12 until the flange 36 rests on lower cap 18.

Figure 2:
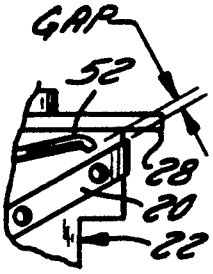
FIG. 2 is an enlarged view of the gap between the end of the ignition wire and the fuse element.
Figure 3:
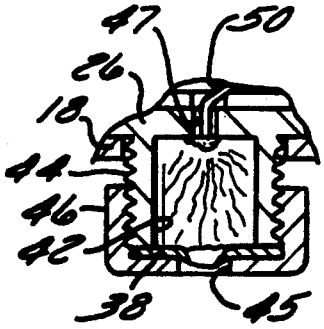
FIG. 3 is a view of the ignition chamber in the lower conductive member after ignition of the pyrotechnic charge.
Figure 4:
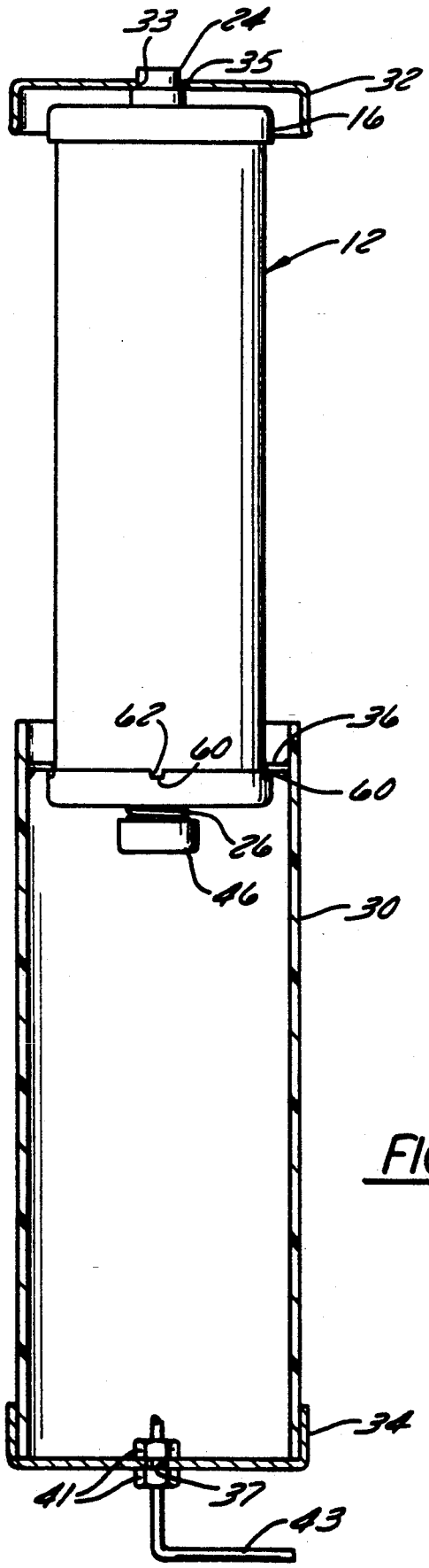
FIG. 4 is a view partly in section showing the position of the protective tube upon disruption of current.

A pyrotechnic charge 48 is mounted in a chamber 42 in boss 26 and is connected to an electrically conductive wire 50 through hole 47 in member 26. The wire 50 is spirally wrapped around the spider assembly 22. The upper end 52 of the wire 50 is located in a spaced relation to the fuse element 20 as shown in FIG. 2. In the event of a fault current condition occurring across the fuse element 20 the element 20 will vaporize, causing a voltage to build up across the gap between the element 20 and the end 52 of the wire 50. When sufficient voltage has built up across the gap, the current will spark over causing current to flow through the wire 50 to the charge 48 which ignites with sufficient pressure to break the end of the conductive wire 43 from the frangible plate 38 as shown in FIG. 3. The weight of the tube 30, cap 34 and wire 43 is sufficient to slide the tube 30 out of the top of end cap 32 allowing the tube 30 to drop to the position shown in FIG. 4. It should be noted that the flange 36 will engage the end cap 18 holding the tube 30 in a suspended position beneath the fuse 12. The fuse tube 14 will be exposed for the first time to the air contaminants and can therefore withstand any voltage across the fuse.

Means are provided on the protective fuse tube 14 for preventing the tube 30 from rotating with respect to the fuse tube 14 so that the hot line clamps can be released from the distribution line. Such means is in the form of a number of teeth 60 provided on ring 36 which are positioned to engage notches 62 in the end cap 18. In the event a fault current occurs, the protective tube 30 will drop to the bottom of the fuse tube 30. The teeth 60 in the ring 36 will be aligned with the notches 62 in the lower end cap 18.

Thus, it should be apparent that there has been provided in accordance with the present invention a protective fuse assembly that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. In combination with a high voltage current limiting fuse having a dielectric fuse tube closed at each end by an end cap, a spider assembly supported in said tube by said end caps, and a granular dielectric material in said fuse tube, said spider assembly including a spider, a conductive member mounted on each end of said spider, and a fuse element spirally wrapped around said spider and being connected to said conductive members, and a protective fuse assembly for protecting the current limiting fuse from the environment, said protective fuse assembly including a protective dielectric tube enclosing said current limiting fuse, a first cap mounted on one end of said protective tube and being supported on the conductive member on the corresponding end of said current limiting fuse, a second cap secured to the other end of said protective tube and to the conductive member on the lower end of the fuse tube and means for releasing said second cap from said conductive member on rupture of said fuse element due to a fault current condition whereby said protective tube will drop out of said first cap to move said second cap away from said fuse tube.

2. The protective fuse assembly according to claim 1 including a ring mounted on the inside of said protective tube in a position to engage the end cap on the lower end of said dielectric fuse tube.

3. The protective fuse assembly according to claim 2 wherein said releasing means comprises a pyrotechnic charge mounted in said lower conductive member and an electrically conductive wire having one end connected to said charge and the other end spaced from the upper end of said fuse element whereby on rupture of said fuse element the voltage present at the upper end of said fuse tube will spark over to the wire to ignite said charge.

4. A protective assembly for a vertically disposed current limiting fuse, said assembly comprising an upper cap mounted on the upper end of said current limiting fuse, a lower cap mounted on the lower end of said current limiting fuse, said lower cap being electrically connected to said current limiting fuse, a protective housing seated in said upper cap and being secured to said lower cap to enclose said current limiting fuse, electrical means in said current limiting fuse for releasing said lower cap from said current limiting fuse to allow said housing and said lower cap to drop out of said upper cap when a fault current is sensed by said fuse, and means in said housing for engaging the lower end of the fuse whereby said lower cap will be separated from the current limiting fuse and the fuse will be exposed to the atmosphere.

5. The protective assembly according to claim 4 wherein the current limiting fuse includes a spider assembly and a conductive fuse element spirally wrapped around said spider assembly, and said electrical means includes a pyrotechnic charge in the bottom of said fuse and a wire connected to said charge and spirally wrapped around said spider assembly, said wire being energized to ignite said charge on rupture of said current limiting fuse.

6. The assembly according to claim 5 wherein said fuse includes an end cap on the lower end thereof, and said upper cap on said assembly interlocks with the end cap on the lower end of the fuse to prevent rotation of said protective housing.

7. The combination of a current limiting fuse and a protective housing assembly enclosing said current limiting fuse to protect the fuse from the surrounding environment, said protective housing assembly including first means for connecting said assembly to the fuse and second means in said fuse for releasing said protective assembly from said fuse when a fault current is sensed by the fuse to expose the current limiting fuse, and holding means on said assembly for supporting said housing assembly on the lower end of the fuse when said housing is released from said housing by said releasing means.

* * * * *